US005170516A

United States Patent [19]

Davison

[11] Patent Number: 5,170,516

[45] Date of Patent: Dec. 15, 1992

[54] UTILITY SEAT

[76] Inventor: William R. Davison, 20140 Coolidge Rd., Big Rapids, Mich. 49307

[21] Appl. No.: 554,708

[22] Filed: Jul. 18, 1990

[51] Int. Cl.[5] ..... A47K 11/04

[52] U.S. Cl. ..... 4/484; 4/239; 4/479; 4/483; 297/193

[58] Field of Search ..... 4/476–480, 4/482–485, 452, 460, 449, 450, 234, 239, 242; 297/193; 43/56; D32/53, 53.1, 54; D23/311; 220/91, 92, 95, 254

[56] References Cited

U.S. PATENT DOCUMENTS

| | | | |
|---|---|---|---|
| 29,278 | 7/1860 | Hidden | 4/483 |
| Re. 32,807 | 12/1988 | Adams | 4/239 X |
| 178,304 | 6/1876 | Kolb | 4/483 |
| 219,866 | 9/1879 | King | 4/483 |
| 506,905 | 10/1893 | Corwin | 4/483 |
| 541,219 | 6/1895 | Weston | 4/483 X |
| 654,301 | 7/1900 | Barnes | 4/234 X |
| 944,001 | 12/1909 | Sheafor | 4/234 |
| 1,287,739 | 12/1918 | Pavlik, Jr. | 4/482 |
| 1,335,095 | 3/1920 | DeGuenther | 4/234 |
| 1,343,287 | 6/1920 | Shafer | 4/477 |
| 1,398,318 | 11/1921 | Courchene | 4/235 |
| 1,743,079 | 1/1930 | Burkett et al. | 4/234 |
| 1,949,442 | 3/1934 | Zundel | 4/234 X |
| 2,111,044 | 3/1934 | Crosby | 4/234 |
| 2,720,658 | 10/1955 | Lea | 4/239 |
| 3,128,905 | 4/1964 | Hesslein | 220/91 |
| 3,381,315 | 5/1968 | Glassberg | 4/484 |
| 3,391,408 | 7/1968 | Anderson | 4/480 |
| 3,428,967 | 2/1969 | Hughes | 4/484 |
| 3,435,464 | 4/1969 | Harding | 4/111 |
| 3,444,563 | 5/1969 | Gordon, Jr. | 4/484 |
| 3,600,719 | 8/1971 | Karr | 4/476 |
| 3,601,822 | 8/1971 | Weiss | 4/234 |
| 3,921,235 | 11/1975 | O'Neil | 4/234 |
| 4,606,080 | 8/1986 | Clementino | 4/460 |
| 4,621,380 | 11/1986 | McGill | 4/476 |
| 4,807,308 | 2/1989 | Person et al. | 4/483 |
| 5,022,946 | 6/1991 | Stewart | 4/242 X |

FOREIGN PATENT DOCUMENTS

| | | | |
|---|---|---|---|
| 242405 | 2/1960 | Australia | 4/483 |
| 295516 | 10/1965 | Australia | 4/483 |
| 0607287 | 10/1960 | Canada | 43/56 |
| 0034257 | 1/1886 | Fed. Rep. of Germany | 4/278 |
| 0457986 | 3/1928 | Fed. Rep. of Germany | 4/234 |
| 186366 | 4/1962 | Sweden | 4/476 |
| 2063 | of 1870 | United Kingdom | 4/483 |
| 0009075 | of 1885 | United Kingdom | 4/483 |
| 0005177 | of 1894 | United Kingdom | 4/483 |
| 4256 | of 1902 | United Kingdom | 4/483 |
| 0306618 | 2/1929 | United Kingdom | 4/476 |
| 814149 | 1/1957 | United Kingdom | 4/476 |

*Primary Examiner*—Henry J. Recla
*Assistant Examiner*—Casey Jacyna
*Attorney, Agent, or Firm*—Price, Heneveld, Cooper, DeWitt & Litton

[57] ABSTRACT

The specification discloses a plural purpose seat attachment for a bucket, and a combination bucket with the seat attachment. The attachment has a cap composed of a polymeric rim and a polymeric plug interfitted with the rim. The rim has an underside annular recess to receive the bucket rim, and a central opening defined by an interior wall. The plug has an exterior wall of a size and shape complementary with the rim interior wall. An O-ring seal and retainer is retained in an annular recess in the plug exterior wall, and compressibly interfits with the rim interior wall to seal the opening and to frictionally retain the plug in the rim until the plug is intentionally removed. The bucket bail interfits with notches in the rim to secure the assembly.

6 Claims, 2 Drawing Sheets

UTILITY SEAT

BACKGROUND OF THE INVENTION

This invention relates to a plural purpose seat attachment for mounting on a conventional polymeric bucket as of plastic, and the combination attachment and bucket.

A convenience and sanitation problem common to outdoor activities such as fishing from a boat, hunting, camping and the like, as well as travel in vehicles, involves the lack of toilet facilities. Although such problems are at times a mere inconvenience, at other times the difficulty becomes much more acute. A partial solution, of course, is to provide the age old slop bucket or pot. However, lugging along such a unit is not only embarrassing, outdated and outmoded, but also requires almost immediate disposal to avoid offense to the olfactory senses. Moreover, such a device has only one use, causing it to constitute otherwise excess weight and space consumption.

SUMMARY OF THE INVENTION

The present invention provides a molded polymeric cap, specially shaped for interfit on a conventional plastic bucket to effect initial use as a carrying device, subsequent use as a rest seat, and alternative use as a toilet facility. The polymeric attachment has ring and plug components which interfit in a manner to seal off the container interior, as well as retaining the plug in place until purposely removed. The molded ring has an annular recess on the underside to receive the bucket rim. The ring has a central opening bounded by an upwardly outwardly curved interior wall which merges into a generally flat top surface. The plug has an exterior wall which corresponds in size and configuration to complement the size and configuration of the ring interior wall. An annular recess in the exterior wall of the plug receives an O-ring seal which not only seals against the surrounding ring to inhibit odor escape, but also serves to create a tight fit to hold the ring and plug together. The ring has a recess adjacent the plug, of a size to receive a person's fingers. The plug has an upwardly outwardly flared edge so that fingers inserted in the noted recess can lift on the flared edge of the plug to overcome the tight frictional fit on the O-ring, to separate the two components. The top surface of the plug and the top surface of the ring together form a coincident support surface for a resting seat. These surfaces are preferably flat and coplanar.

A plastic trash bag can be inserted into the bucket with the margin of its open end retained between the bucket rim and the ring to retain contents for easy removal and disposal at a later appropriate time and place. The plastic bag employed can be removed and closed, at which time another empty bag can be inserted for later use.

The apparatus provides a simple, lightweight, largely unnoticeable, plural purpose device using a conventional three, four or five gallon bucket as the main container. These and several other features, objects and advantages of the invention will become apparent upon studying the following specification in conjunction with the drawings.

DESCRIPTION OF THE PREFERRED EMBODIMENT

Referring now specifically to the drawings, the assembly 10 is shown to include a conventional plastic bucket 12 typically of three gallon or five gallon size, such having a conventional bail 14 attached on opposite sides of the bucket. An upper, annular rim 12' extends around the opening of the bucket, and an annular, outwardly protruding shoulder 12'' outside of and beneath the level of rim 12'. Shown within this widely used, conventional polymeric bucket is a flexible, plastic bag 16, e.g., a so-called trash bag, having an opening at one end and a margin 16' around the opening.

Figure 1:
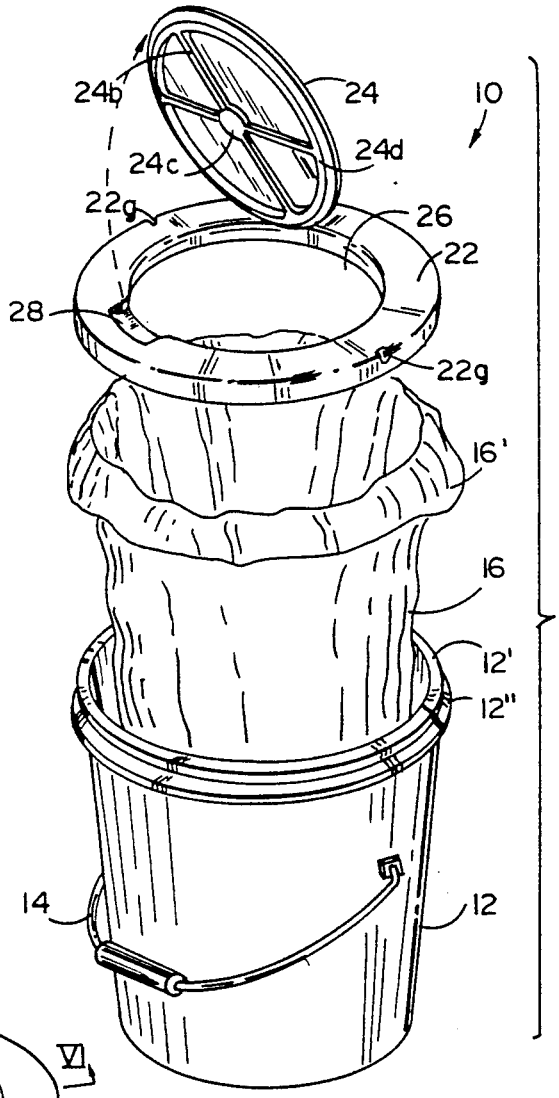
FIG. 1 is a perspective, exploded view of the components for the present invention.
Figure 2:
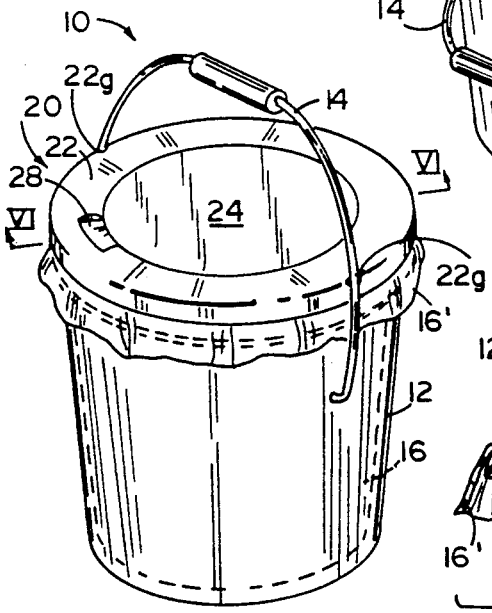
FIG. 2 is a perspective view of the assembled components in FIG. 1.

On top of and interfitting with the rim of the bucket is a novel cap subassembly 20 comprising an annular rim member 22 and a plug member 24. These two components are of polymeric material, preferably molded, and formed to interfit with each other in a special fashion. Rim 22 includes a top surface **22*a* and has an annular underside recess 22*b* formed between an outer skirt flange 22*c* and an inner flange 22*d*. The annular recess 22*b* is of a diameter comparable to the rim 12' of bucket 12 to receive the bucket rim. The surface of flange 22*d* is tapered to assure proper fit on buckets which may vary in diameter from one to another. Polymeric rim 22 has a central through opening 26 (FIG. 1) defined by an interior wall 22*e* of rim 22. This interior wall extends upwardly and outwardly, preferably curved, to blend into the flat upper surface 22*a*. The lower part of wall 22*e* preferably is substantially vertical and of a diameter just larger than the plug but smaller than the overall diameter of the O-ring around the plug. Rim 22 also has at one portion of its circumference a recess 28 several inches wide in the top surface of the rim to allow insertion of a person's fingers. This recess is formed by a downwardly extending portion 22' of the rim, such recess extending radially inwardly to opening 26** and having a width sufficient to receive the fingers of a person's hand, for reasons noted hereinafter.

Figure 6:
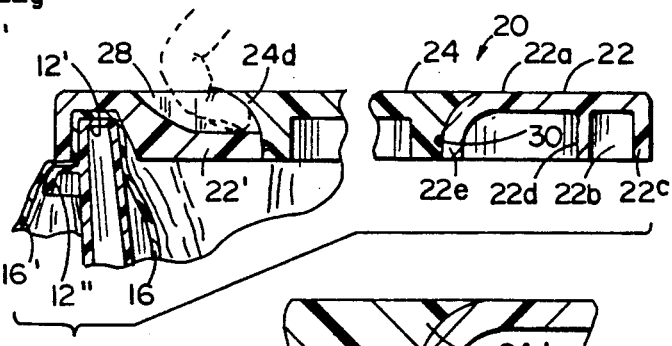
FIG. 6 is a fragmentary, sectional view taken on plane VI—VI of FIG. 2.

Underside annular recess **22*b* can contain a resilient, flexible gasket or seal member (not shown), if desired. It receives the similarly configurated upper rim 12' of bucket 12 in a closely fitting manner depicted in FIG. 6, the bucket and polymeric rim preferably sandwiching the upper marginal portion 16' of plastic bag 16 therebetween to retain the bag in position and preferably to also seal off this annular area. Outer skirt 22*c* preferably has an abutting relationship with shoulder 12'' (FIG. 6**) to further seal off this area.

Figure 7:
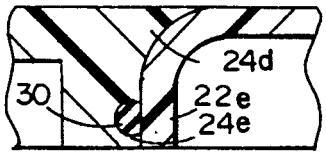
FIG. 7 is an enlarged, fragmentary, sectional view of the interfitted plug and rim of the cap.
Figure 3:
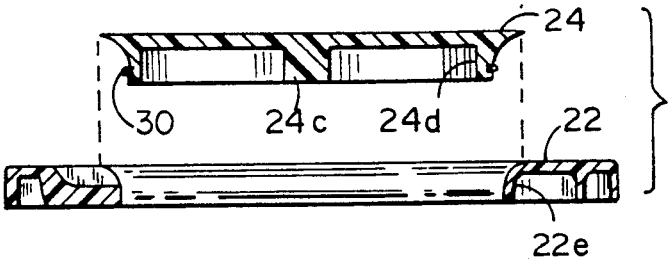
FIG. 3 is a sectional exploded view of the novel cap of this invention.
Figure 4:
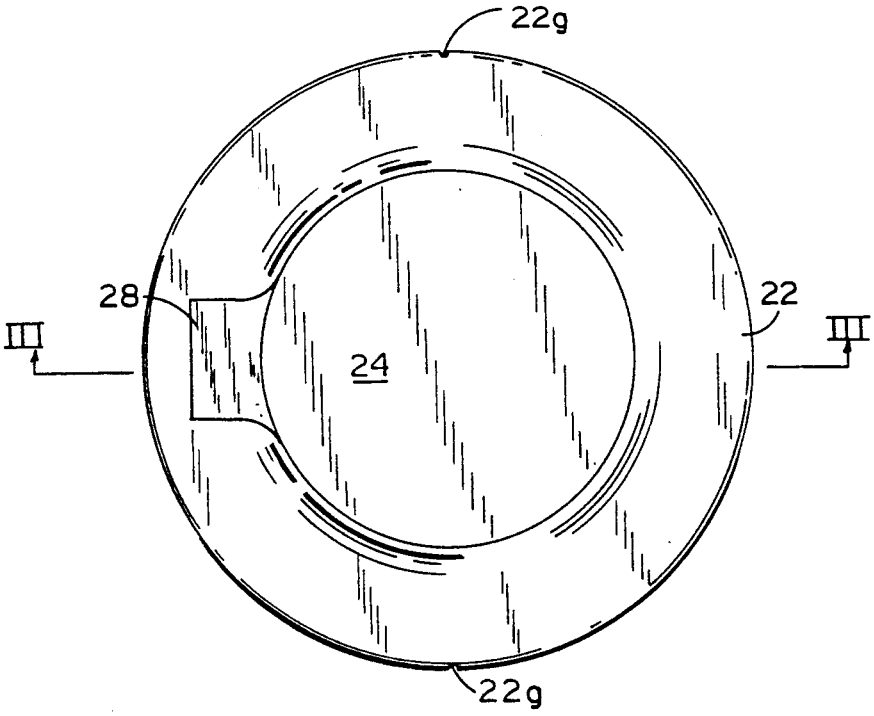
FIG. 4 is a plan view of the outer, rim component in FIG. 3.
Figure 5:
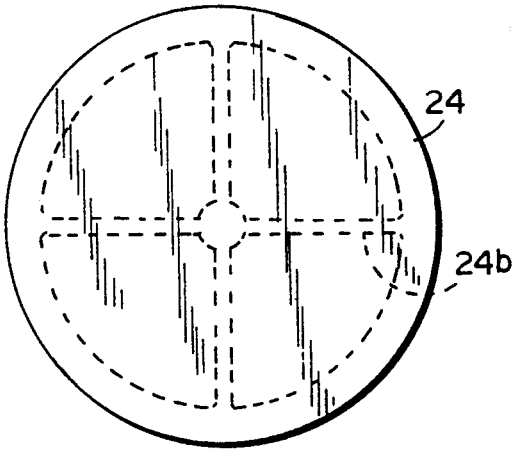
FIG. 5 is a plan view of the plug component of FIG. 3.

Plug 24 also has a flat top surface **24*a* coplanar with rim upper surface 22*a* when the two components are interconnected. This plug member preferably has a plurality of reinforcing ribs 24***b* on the underside thereof, extending between a protruding central hub 24*c* and outer wall 24*d*, enabling it to form part of a seat. This outer wall flares upwardly and outwardly (FIGS. 6 and 7), having a size slightly smaller than the interior wall 22*e* of rim 22, and having a configuration complementary to that of wall 22*e*. Wall 22*e* and wall 24*d* preferably have the curvilinear configuration depicted. The two components, when interfitted, provide a flat, i.e., planar, seating surface on the top of the combination. Formed into wall 24*d* is an inwardly extending annular recess 24*e* which receives an annular resilient rubber or rubber-like O-ring 30. This O-ring has two functions, the first being to seal the connection between the plug and the rim when the two are interconnected, and the second being to provide a tight friction fit for the plug in the rim, to assure that the plug stays in position in the rim until purposely removed therefrom. The O-ring when installed has an outer diameter greater than the smallest diameter of the lower portion of opening 26, such that it takes a small force to press the O-ring into closed position with this portion of the rim, since this compressibly distorts the O-ring (FIG. 7). This retains the plug in interfitted relation to the rim. Removal is by inserting one's fingers F into recess 28 beneath the flared outer edge of plug 24 (FIG. 6) and lifting to overcome the friction fit on the O-ring.

Rim 22 has a pair of notches 22*g* (FIG. 1) opposite each other and on the upper outer edge of rim 22, to receive bail 14 when the bail is vertically up. This holds the cap subassembly on the bucket.

Thus, when going on a fishing expedition, on a deer hunting outing, a campout, or other such event, the plastic bucket 12, covered by subassembly 20, can be utilized to carry supplies, e.g., fishing poles, etc., as desired, in the boat or into the woods, or otherwise. It can subsequently be employed as a normal seat. Equally important, it can be employed as a toilet facility, as necessary, by removal of plug 24. This is done by placing one's fingers in recess 28 and lifting on the flared plug edge to release the plug and lift the plug out of its retained position on rim 22. The rim is then used temporarily as a seat. After use, the plug is returned to seal off opening 26. At this time, or later, bag 16 and its contents can be closed and removed from the bucket by first lifting the rim and plug subassembly from the bucket, followed by disposal of the closed bag and its contents and, if desired, replacement of it with a clean bag.

The assembly thus has a multiple of purposes, and is not particularly noticeable so as to be an embarrassment to the persons carrying such to the destination. The cap subassembly will interfit with any of the conventional buckets, usually of plastic, widely distributed and available today.

Certain additional advantages, features, or even some minor modifications, may be apparent to those skilled in this art, upon studying the above disclosure. The invention is not intended to be limited to the specific preferred embodiment illustrated, but only by the scope of the appended claims and the reasonably equivalent structures to those defined therein.

The embodiments of the invention in which an exclusive property or privilege is claimed are defined as follows.

1. A plural purpose seat attachment for combination with a bucket comprising:

a two-component bucket cap comprising a polymeric rim and a polymeric plug;

said rim being annular in shape, defining an upper surface, having an annular underside recess to receive a bucket rim, and having a central through opening defined by an interior wall around said opening;

said plug having a top surface and having an upwardly outwardly extending peripheral exterior wall corresponding in size and of complementary configuration to the size and configuration respectively of said rim interior wall to be interfittable therewith, said plug top surface being aligned with said rim upper surface and both being unobstructed, to form a utility seat;

said plug exterior wall having an annular recess;

said rim upper surface and said plug top surface being generally flat and coplanar with each other, with said rim including a finger receiving recess and said plug having a flared outer edge for lifting said plug from said rim by inserting fingers in said recess and under said flared edge;

an annular seal and engagement retainer between said rim interior wall and said plug exterior wall to seal said plug to said rim and retain said plug on said rim;

said seal comprising an O-ring retained in said annular recess; and said O-ring being frictionally interengageable with said rim interior wall to retain said plug on said rim to define said engagement retainer.

2. The seat attachment in claim 1 wherein said finger receiving recess is in said one portion of said rim, extending to said opening.

3. The seat attachment in claim 2 wherein said rim has notches in its outer periphery to receive the bail of a bucket.

4. A plural purpose combination bucket and seat attachment comprising:

a bucket having an open top and a peripheral rim around said open top;

a bucket cap comprising a polymeric rim and a polymeric plug;

said polymeric rim being annular in shape, defining an upper surface having an annular underside recess to receive a bucket rim, and having a central throughopening defined by an interior wall around said opening;

said plug having a top surface and having a peripheral exterior wall corresponding in size and complementary configuration to the size and configuration respectively of said rim interior wall to be interfittable together, said plug top surface being aligned with said rim upper surface when said plug and rim are interengaged, to form a generally flat and coplanar utility seat thereby;

an annular seal and engagement retainer between said rim interior wall and said plug exterior wall to seal said plug to said rim and to form a friction fit to retain said plug to said rim;

said seal and retainer being a compressible rubber or rubber-like element forming a friction fit;

said plug exterior wall and said rim interior wall flaring upwardly and outwardly in a curvilinear configuration;

said O-ring having a compression fit with said rim interior wall to frictionally retain said plug to said rim until said rim is grasped and removed by fingers; and said polymeric rim having a recess of a width sufficient to allow fingers to be placed therein to grasp said plug exterior wall and remove said plug.

5. The combination in claim 4 including a flexible plastic bag in said bucket, with its margin retained between said bucket rim and said bucket cap rim.

6. The combination in claim 4 wherein said rim has notches in its outer periphery, said bucket has a bail, and said notches receive said bail when the bail is upright.

* * * * *